US005298703A

United States Patent [19]

Yatsuzuka et al.

[11] Patent Number: 5,298,703

[45] Date of Patent: Mar. 29, 1994

[54] GAS CIRCUIT BREAKER

[75] Inventors: Hirohiko Yatsuzuka; Tuneo Kishi; Takashi Minakawa; Isao Nishida, all of Hitachi, Japan

[73] Assignee: Hitachi Ltd., Tokyo, Japan

[21] Appl. No.: 758,679

[22] Filed: Sep. 12, 1991

[30] Foreign Application Priority Data

Sep. 14, 1990 [JP] Japan ..... 2-242397

[51] Int. Cl.[5] ..... H01H 33/16; H01H 33/82

[52] U.S. Cl. ..... 200/148 R; 200/144 AP

[58] Field of Search ..... 200/144 R, 144 AP, 148 R, 200/149 B

[56] References Cited

U.S. PATENT DOCUMENTS 4,293,749 10/1981 Kishi et al. ..... 200/144
4,500,762 2/1985 Yoshizumi ..... 200/144 AP
5,039,831 8/1991 Sato et al. ..... 200/144 AP

FOREIGN PATENT DOCUMENTS 0050341 10/1981 European Pat. Off. ..... 33/16
0335338 3/1989 European Pat. Off. ..... 33/16
2476382 2/1981 France ..... 33/42

*Primary Examiner*—A. D. Pellinen
*Assistant Examiner*—Michael A. Friedhofer
*Attorney, Agent, or Firm*—Antonelli, Terry, Stout & Kraus

[57] ABSTRACT

A three-phase common tank type gas circuit breaker has a grounded tank filled with an insulating gas and accommodating three interrupter assemblies for three phases of the electric power. Each assembly includes a parallel electrical connection of an interrupter having stationary and movable contacts, a capacitor and a closing resistor. The interrupters for the three phases are disposed in spaced relationship circumferentially of the tank and have axes extending axially of the tank. The closing resistor for each phase is disposed on one side of the associated interrupter adjacent an adjacent interrupter for a different phase, while the capacitor for each phase is disposed on the inner or outer side of the associated interrupter, whereby the radial and axial dimensions of the grounded tank can be reduced.

6 Claims, 5 Drawing Sheets

GAS CIRCUIT BREAKER

BACKGROUND OF THE INVENTION

1. Field of the Invention

The present invention relates to a three-phase common tank type gas circuit breaker and, more particularly, to a three-phase common tank type gas circuit breaker used in a large power system such as of 550 KV and which has single-break closing resistors and capacitors.

2. Description of the Prior Art

Power systems of high voltage and large capacity are becoming a matter of great concern in view of the recent increasing demand for electrical power. This has given a rise to a demand for increased capacities of circuit breakers, used in substations to break greater powers of higher voltages. Circuit breakers also are required to have a reduced number of breaks as well as to cope with the increase in the power to be broken, in order to attain an improved braking performance. More specifically, dual break type circuit breakers capable of breaking 50 KA current, usable in 550 KV line for example, have been put in practical use. However, a demand exists for single break circuit breaker of the same class as above. This applies also to the case of gas-insulated circuit breakers. For example, in Japanese Patent Unexamined Publication No. 2-46616 a single break circuit breaker, a so-called three phase common tank type gas circuit breaker, is proposed wherein, interrupters for three phases are accommodated by a common hermetic tank so as to reduce the size of the entire gas-insulated circuit breaker.

In this circuit breaker, in order to deal with an electric line of a large capacity of the order of 550 KV, a closing resistor for limiting closing switching overvoltage and a capacitor for limiting transient recovery voltage are disposed in parallel with the interrupter of each phase.

In the prior art described, the circuit breaker has a grounded tank and three-phase assemblies for the three phases of the power accommodated in the grounded tank, with each assembly having an interrupter, a closing resistor and a capacitor connected in parallel with the interrupter. More specifically, the closing resistors are disposed on the radially inner side of the interrupters and the capacitors are disposed in the central region of the grounded tank, with the closing resistors and the capacitors being shielded by a cylindrical shield member. Single break function requires that one interrupter is associated with a capacitor which corresponds in capacitance to those used for conventional dual break type breakers. In addition, circuit breakers for use in such a large power line as of 550 KV class require closing resistors which have a length of about one meter and which are connected in series. The arrangement of the closing resistors in the prior art circuit breaker, therefore, cannot provide a compact circuit breaker because the dimensions of the circuit breaker tend to be increased due to large axial dimensions of the closing resistors.

SUMMARY OF THE INVENTION

Accordingly, an object of the present invention is to provide a large capacity, compact three-phase common tank circuit breaker for high voltage which has reduced axial and radial dimensions.

Another object of the present invention is to provide a compact three-phase common tank circuit breaker in which the tank has reduced axial and radial dimensions.

These objects of the present invention are achieved by a three-phase common tank type circuit breaker which comprises interrupters for the three phases disposed at a predetermined circumferential spacing within the grounded tank such that the axes of the interrupters extend substantially in parallel with the axis of the grounded tank, a closing resistor for each phase disposed on one side of the associated interrupter adjacent a neighboring interrupter of a different phase, a capacitor for each phase disposed in the grounded tank on the inner or outer side of the associated interrupter, and shield members provided for the stationary and movable sides of the interrupter for each phase.

The closing resistors for the three phases are disposed at a circumferential interval and located in the vicinity of the associated interrupters in the grounded tank, while the capacitors are disposed on the radially inner side of the associated interrupters and in close proximity therewith. Therefore, the axial and radial dimensions of the grounded tank can be reduced to provide a compact gas circuit breaker.

The above and other objects, features and advantages of the present invention will become more apparent from the following description with reference to the accompanying drawings.

DESCRIPTION OF THE PREFERRED EMBODIMENTS

Figure 1:
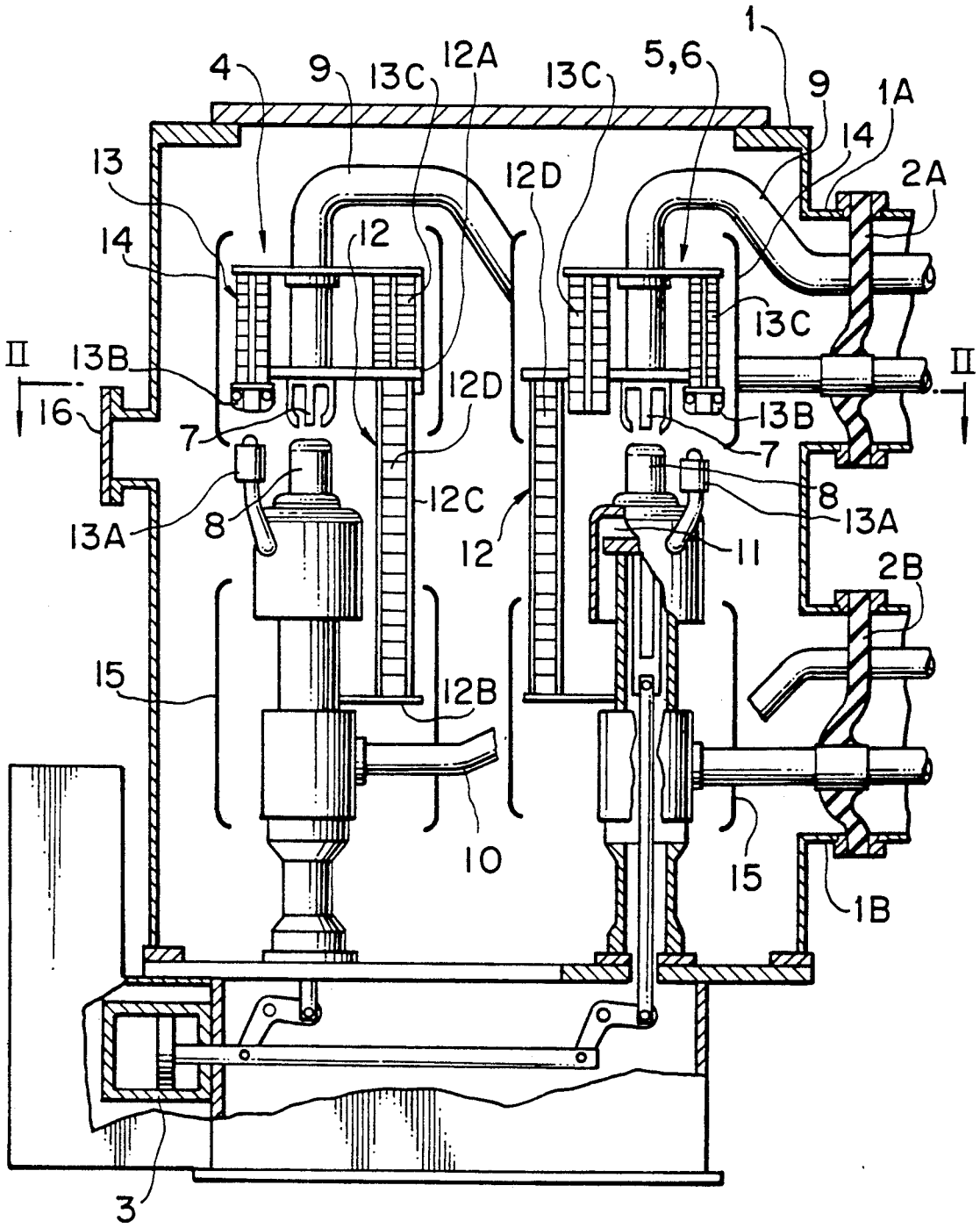
FIG. 1 is a vertical sectional view of an embodiment of the gas circuit breaker in accordance with the present invention.
Figure 2:
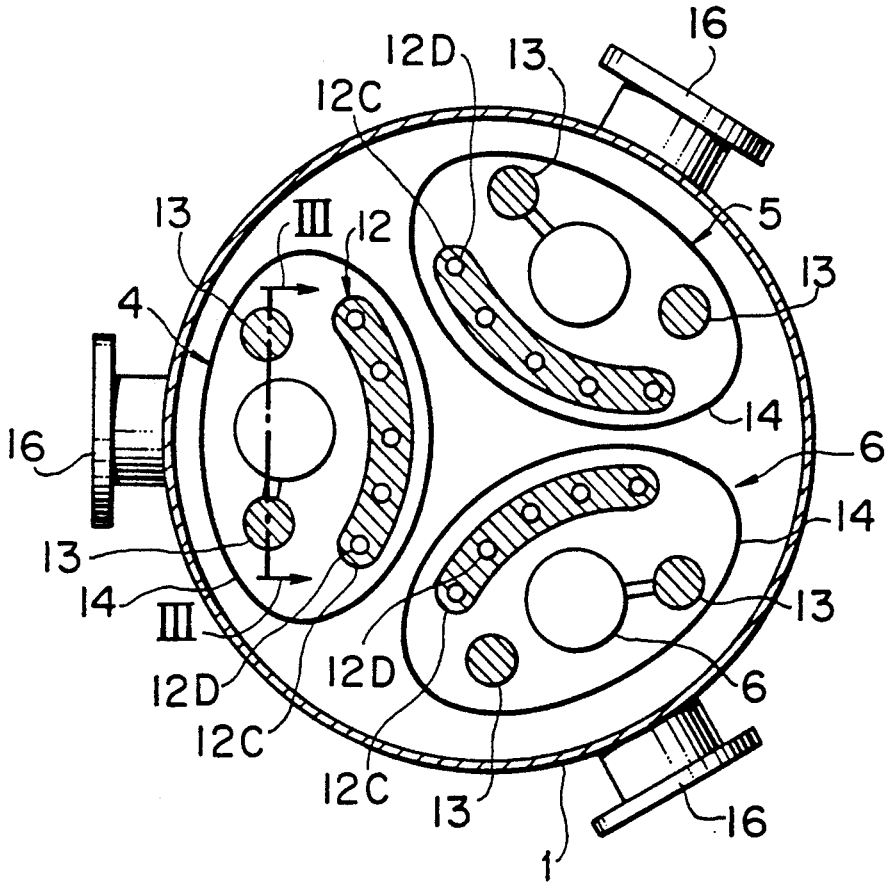
FIG. 2 is a sectional view taken along the line II—II of FIG. 1.
Figure 3:
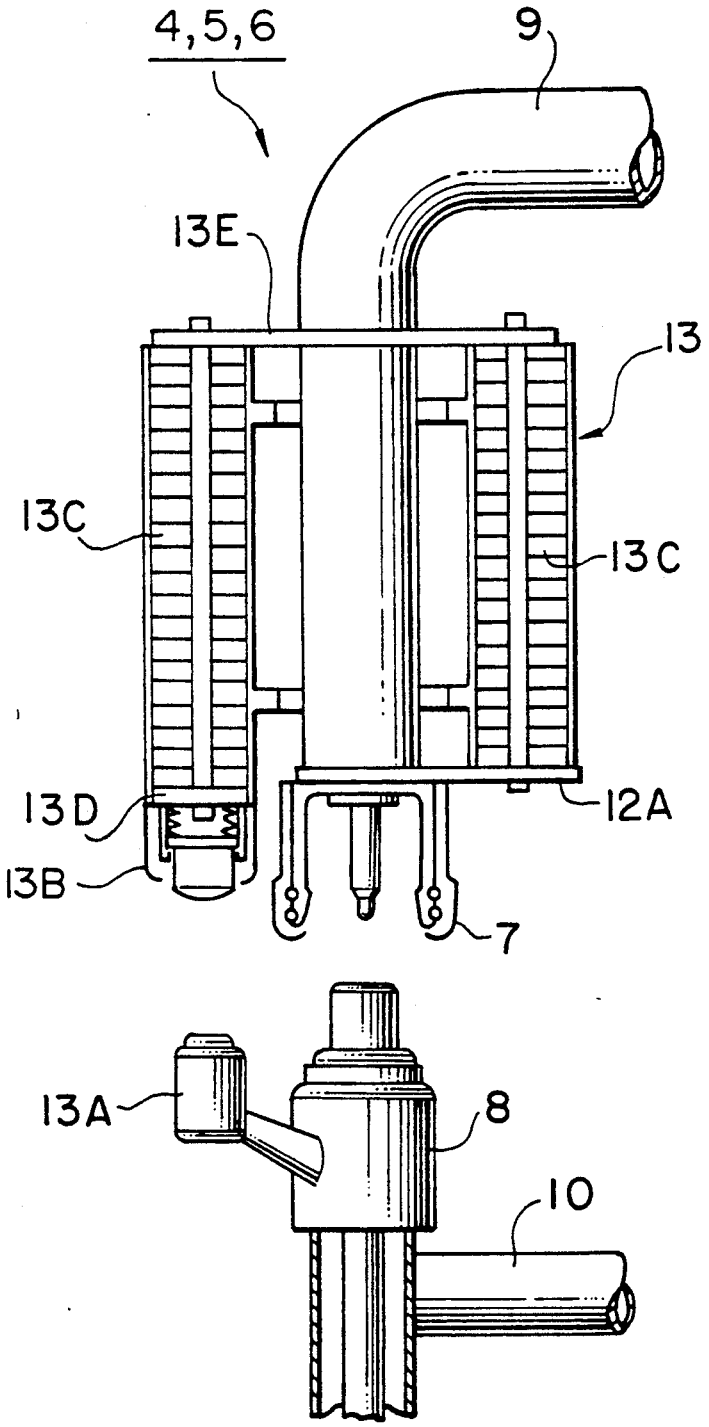
FIG. 3 is a sectional view taken along the line III—III of FIG. 2.

Referring now to the drawings wherein like reference numerals are used throughout the various views to designate like parts and, more particularly, to FIGS. 1-3, according to the present invention, a grounded tank 1 includes lead portions 1A, 1B projecting radially outwardly from a wall of the tank 1 at an upper portion and a lower portion of the tank 1. The lead portions 1A, 1B are hermetically closed by insulating spacers 2A, 2B. An actuating element 3 is provided for operating or actuating interrupters, with the actuating equipment being provided in a lower portion of the grounded tank 1. The grounded tank 1 is charged or filled with an arc quenching gas and accommodates three puffer-type interrupters 4, 5, 6 for three phases of electrical power, with the puffer-type interrupters 4, 5, 6 being arranged substantially at a 120° interval as shown most clearly in FIG. 2.

In the embodiment of FIGS. 1-3, the interrupters 4, 5, 6 are arranged such that respective longitudinal axes thereof extend in a vertical direction. Thus, each of the interrupters 4, 5, 6 include a stationary contact 7 and movable contact 8 disposed in opposition to the stationary contact 7. The stationary contact 7 is connected to an upper lead conductor 9, with the movable contact 8 being connected to a lower lead conductor 10. The movable contacts 8 for the three phases are adapted to be moved into and out of contact with associated stationary contacts by operation of the actuating equipment 3. Arcs generated by separation of the movable contact 8 from the stationary contact 7 are extinguished by a flow of high pressure gas generated by a gas compression means or puffer cylinders 11.

Capacitor means 12 for limiting transient recovery voltage and closing resistors 13 for limiting closing switching overvoltage are disposed in each of the, interrupters 4 to 6. The capacitors means 12 includes capacitor and resistor mounting members 12A and capacitor mounting members 12B which also act as connecting conductors and which are provided on the stationary contact 7 and the movable contact 8, respectively, an insulating bulkhead 12C provided between the mounting members 12A and 12B and having axial columnar cavities, and a plurality of capacitor elements 12D received in the cavities in the bulkhead. The insulating bulkhead 12C suppresses any influence of a hot gas generated at the time of breaking and improves the insulation between different phases. In order to enable an efficient use of the limited space in the grounded tank, the capacitor means 12 have arcuate cross-sections and are positioned at radially inner sides of the interrupters 4, 5 and 6. Each closing resistor has a moving resistor contact 13A associated with the moving contact 8, a stationary resistor contact 13B associated with the stationary contact 7, and resistor elements 13C are provided between the stationary resistor contactor 13B and the stationary contact 7. In order to minimize the dimension in the axial direction, the resistor 13C is composed of stacks of resistor elements grouped into two groups which are arranged on both sides of each of the interrupters 4, 5 and 6 and which are supported and connected through a resistor mounting member 13D and the capacitor and resistor mounting member 12A which also serve as connecting conductors, as will be seen from FIGS. 2 and 3. Namely, as will be clearly understood from FIG. 2, the resistor elements 13C of the resistor 13 for each phase are arranged in the circumferential direction rather than in the radial direction of the grounded tank 1. This arrangement is effective to reduce the radial and axial dimensions of the grounded tank 1. Referring again to FIG. 2, each of the interrupters 4 to 6 is provided with an electric-field reducing shield member 14 which covers the stationary side of the interrupter, i.e., the stationary contact 7, the stationary resistor contact 13B and the resistor 13C of the closing resistors, and a part of the capacitor 12. A shield member 15 also is provided on the movable side of each of the interrupters 4, 5 and 6 so as to partly cover the movable contact 8 and a part of the capacitor 12. Each of the shield members has greater radii of curvatures at their portions facing different phases and the grounded tank than at other portions and, hence, has an elliptical cross-section.

The grounded tank 1 is provided with maintenance hand halls 16 formed in the portions thereof adjacent the interrupters 4 to 6.

In the illustrated embodiment of FIGS. 1-3, since the resistor elements 13C of the closing resistor 13 are arranged in two groups disposed on both sides of each of the associated interrupter 4, 5 and 6 and extend in parallel with the axis of the interrupter, any increase in the radial and axial dimensions of the grounded tank 1 due to installation of the resistor elements 13C can be suppressed. More specifically, the diameter of the grounded tank 1 can be reduced by 70% as of that of the known compared with a conventional three-phase common tank type gas circuit breaker hereinabove. In addition, the insulated bulkhead of the capacitor 12 effectively prevents mixing of hot gases generated from different phases at the time of breaking, thus preventing reduction in the insulation between different phases. Furthermore, inspection and replacement of the component parts of the interrupters are facilitated by virtue of the provision of the hand halls 16.

Figure 4:
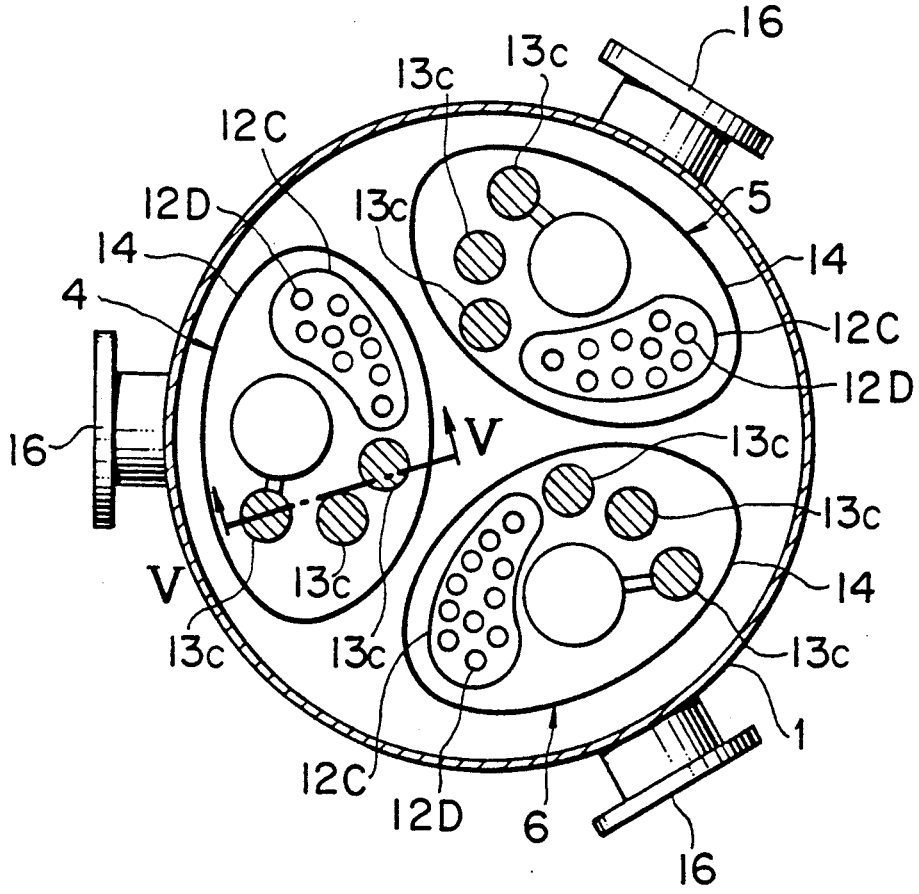
FIG. 4 is a cross-sectional view of another embodiment of the gas circuit breaker in accordance with the present invention.
Figure 5:
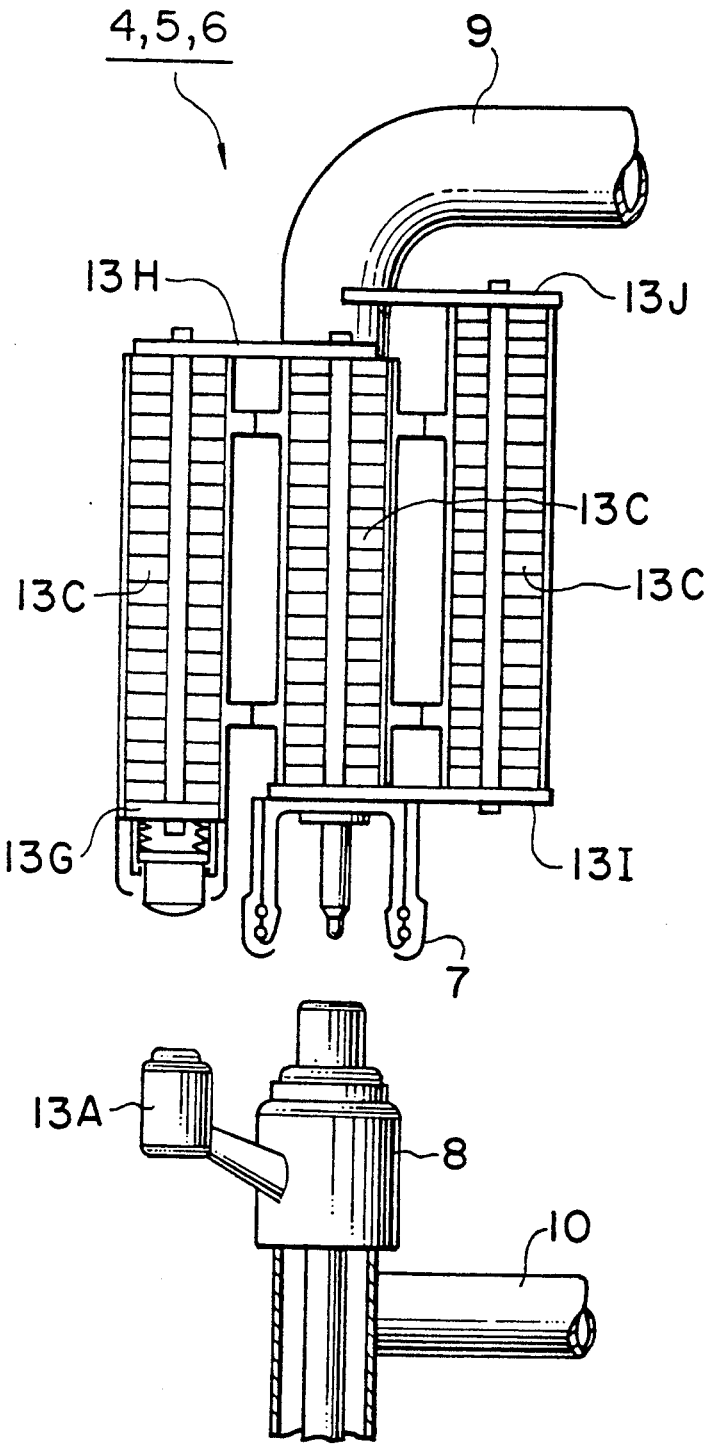
FIG. 5 is a sectional view taken along the line V—V of FIG. 4.

The embodiment of FIGS. 4 and 5 is suitable for use in situation wherein the closing resistor has a greater capacity. The resistor elements 13C are arranged in three parallel groups which are disposed on one side of each of the associated interrupters 4, 5 and 6 and which are supported by mounting members 13G to 13J which also serve as connecting conductors..

It will be clear that embodiment of FIGS. 4 and 5 offers the same advantages as those provided by the embodiment of FIGS. 1-3.

The described embodiments of the invention have reduced dimensions of the grounded tanks and, thus, can conveniently be used in a gas-insulated switch gear, making it possible to reduce the length of generating line, thus enabling the size and the cost of the switch gear to be reduced.

According to the present invention, the dimension of the grounded tank can be reduced not only in the axial direction but also in the radial direction by virtue of the fact that the closing resistors of respective interrupters are disposed at the sides of the interrupters. It is therefore possible to provide a three-phase common tank type gas circuit breaker with minimized tank diameter.

What is claimed is:

1. A three-phase common tank type gas circuit breaker comprising:

a grounded tank filled with an insulating gas;

interrupter assemblies for three phases of electrical power, said interrupter assemblies being disposed in said grounded tank and arranged in a circumferential direction thereof;

each interrupter assembly including an interrupter having a stationary contact and a movable contact, capacitor means, and closing resistor means having resistor elements and stationary and movable resistor contacts;

the interrupters of said interrupter assemblies being circumferentially spaced with respect to the grounded tank and having longitudinally extending axes extending substantially in parallel with a longitudinal axis of the grounded tank;

the capacitor means of each interrupter assembly being disposed on an inner side of the assembly as viewed radially of said grounded tank;

the closing resistor means of each interrupter assembly is disposed on a side of the interrupter, said side being adjacent a a peripheral wall of said grounded tank;

each interrupter assembly having stationary and movable sections;

shield members disposed around said stationary and movable sections of each of the respective interrupter assemblies.

2. A gas circuit breaker according to claim 1, wherein said shield members of each interrupter assembly have larger radii of curvatures at surfaces thereof facing other assemblies and at surfaces thereof facing the grounded tank than at other portions of said shield members.

3. A gas circuit breaker according to claim 2, wherein said shield members each having an elliptical cross-sectional shape.

4. A gas circuit breaker according to claim 1, wherein said resistor elements of said closing resistor means of each interrupter assembly are disposed in parallel with at least one side of the interrupter assembly.

5. A gas circuit breaker according to claim 1, wherein said resistor elements of said closing resistor means of each interrupter assembly are in parallel with both sides of the interrupter assembly.

6. A gas circuit breaker according to claim 1, wherein said capacitor means of each interrupter assembly has capacitor elements accommodated in cavities formed in an insulated bulk head.

* * * * *